United States Patent [19]

Murphy

[11] Patent Number: 4,756,134

[45] Date of Patent: Jul. 12, 1988

[54] APPARATUS FOR RETAINING INSULATION BETWEEN METAL BEAMS

[75] Inventor: Wesley T. Murphy, Auburn, N.Y.

[73] Assignee: Etco Building Systems, Inc., Auburn, N.Y.

[21] Appl. No.: 74,634

[22] Filed: Jul. 17, 1987

[51] Int. Cl.[4] ..... E04B 1/74

[52] U.S. Cl. ..... 52/404; 52/407; 52/721

[58] Field of Search ..... 52/406, 407, 712, 404

[56] References Cited

U.S. PATENT DOCUMENTS

| | | | |
|---|---|---|---|
| 2,147,276 | 2/1939 | Weiss | 52/407 |
| 3,355,203 | 11/1967 | Stauffer | 52/712 |
| 3,783,569 | 1/1974 | Roussin | 52/404 |
| 4,375,741 | 3/1983 | Paliwoda | 52/407 |
| 4,437,282 | 3/1984 | O'Brien | 52/407 |
| 4,658,557 | 4/1987 | Mulford | 52/407 |

*Primary Examiner*—Henry E. Raduazo

*Attorney, Agent, or Firm*—Wall and Roehrig

[57] ABSTRACT

A spring wire member for retaining insulation against a building panel supported upon spaced apart flanged metal beams. The member, when in an unloaded condition, contains three parallel legs that are joined by semicircular elbows including a center leg having a length that is substantially greater than the space between adjacent beams and two end legs each of which having a length that is slightly greater than the space between the beams whereby the member can be obliquely positioned inside the flanges of adjacent beams and the end legs extended to a position normal to the center leg whereby the extended member is loaded in biasing contact against the adjacent beams.

7 Claims, 1 Drawing Sheet

APPARATUS FOR RETAINING INSULATION BETWEEN METAL BEAMS

BACKGROUND OF THE INVENTION

This invention relates to a metal building system and, in particular, to a spring member for supporting insulation between spaced metal beams.

Metal building systems are finding wider use in the building industry because of the many advantages associated with this type of construction. Buildings employing metal support members are stronger when compared to similar structures made of wood. Metal members also will not rot or be attacked by insects and are generally inpervious to atmospheric conditions. Insulating a metal structure, however, sometimes can be difficult because the metal studs or rafters which contain the insulation material will not accept conventional fasteners such as staples, nails and the like. Attempts to hold the insulation in place using longitudinally disposed slats have for the most part proven to be unsuccessful. The slats are usually spaced some distance apart and as a consequence, the insulation material will sag or fall between the slats thus destroying the insulation barrier.

SUMMARY OF THE INVENTION

It is therefore an object of the present invention to improve metal building systems.

It is a further object of the present invention to facilitate the installation of insulation in a building having metal structural components.

It is another object of the present invention to provide a support member that can be used with metal studs and rafters to securely hold strips of insulation adjacent a building panel.

Another object of the present invention is to provide a spring-like insulation support member that can be snap locked between two metal beams to securely hold a strip of insulation inside the beams.

These and other objects of the present invention are attained by means of a spring-like wire member for retaining a strip of insulation between two spaced metal beams having end flanges. The member when in a non-loaded condition contains three parallel legs that are joined by semi-circular elbows. The legs include a center leg having an axial length that is substantially greater than the space between the beams and two end legs each having a length that is only slightly greater than the space between the beams whereby the member can be obliquely mounted inside the flanges of adjacent beams beneath the insulation strip and the end legs extended to a loaded position normal to the center leg whereby the member is locked in biasing contact against the adjacent beams.

BRIEF DESCRIPTION OF THE INVENTION

For a better understanding of these and other objects of the present invention reference is had to a detailed description of the invention which is to be read in conjunction with the accompanying drawing, wherein.

DESCRIPTION OF THE INVENTION

Figure 1:
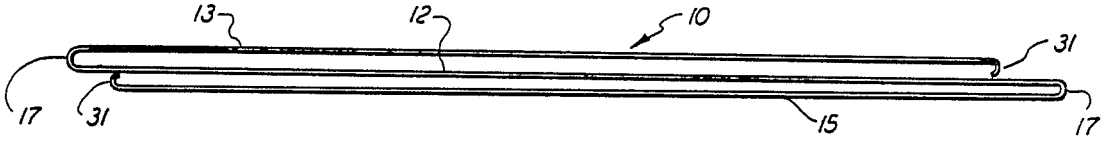
FIG. 1 is an enlarged plan view showing a spring member embodying the teachings of the present invention in an unloaded condition.

Referring now to FIG. 1, there is shown a support member, generally referenced 10, that embodies the teachings of the present invention which is formed of a single piece of 1/16" to ⅛" diameter wire. The member is preferably formed of a low cost hard-drawn spring wire, such as ASTM A227-47 wire, that does not have to be hardened or tempered and which can be cold worked to assume the unloaded form as illustrated in FIG. 1. The wire includes a center leg 12 of predetermined length that is joined at opposite ends to a pair of shorter end legs 13 and 15 by means of semi-circular elbows 17—17.

Figure 2:
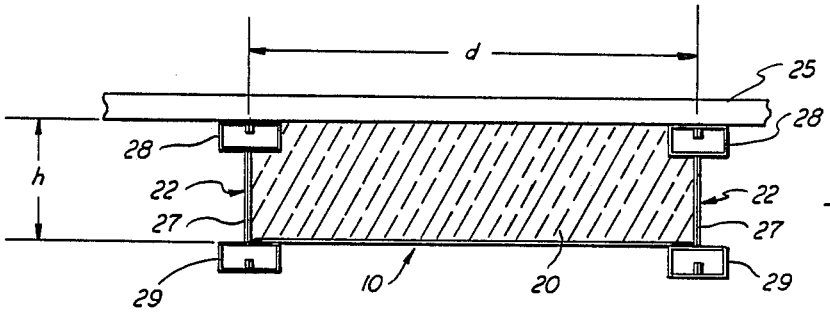
FIG. 2 is a partial side elevation of a metal building system showing the spring member of FIG. 1 positioned between two adjacent metal beams.

The support member is specifically designed to hold insulation material in place within a building system of the type utilizing metal structural components. FIG. 2 shows a typical installation wherein a sheet of insulation 20 is laid between a pair of beams 22—22 in juxtaposition with a building panel 25. The term "beam" is used herein in a broad sense to define any type of structure support member such as a floor joist, a wall stud, or a ceiling rafter between which insulation is usually laid or packed to establish an energy barrier. Similarly, the building panel may be fabricated of any type of material and can include siding, roofing, and flooring of all types that is laid over or upon the beams and fastened thereto by any suitable means.

The insulation is normally provided to the installer in rolls of varying widths. The insulation material is attached to a continuous strip of backing paper and the roll is cut into desired lengths by the installer. In a conventional building of wooden construction, the insulation strips are generally laid between the studs and fastened in place by tacking or stapling the backing sheet to the opposing studs at appropriate intervals. This means of fastening, however, cannot be employed in structures using metal supports.

Beams 22—22 are similar to those described in prior U.S. Pat. No. 4,389,829. Each beam contains a thin vertical web 27 and a pair of opposed horizontally disposed end flanges 28 and 29. Insulation strip 20 is of predetermined width and depth and is placed between beams so that it fills the space between the lower flanges 29—29 and the building panel 25. The depth of the insulation material is preferably greater than height h so that the material can be packed solidly into this area to completely fill the void between the beams and thus establish an efficient thermal barrier to prevent the loss of energy from the building.

Figure 3:
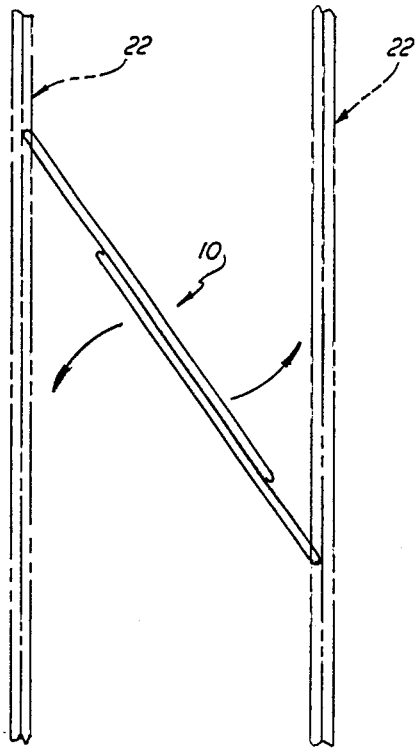
FIG. 3 is an end view showing the support member of FIG. 1 in an unloaded condition obliquely positioned between two spaced metal beams.
Figure 4:
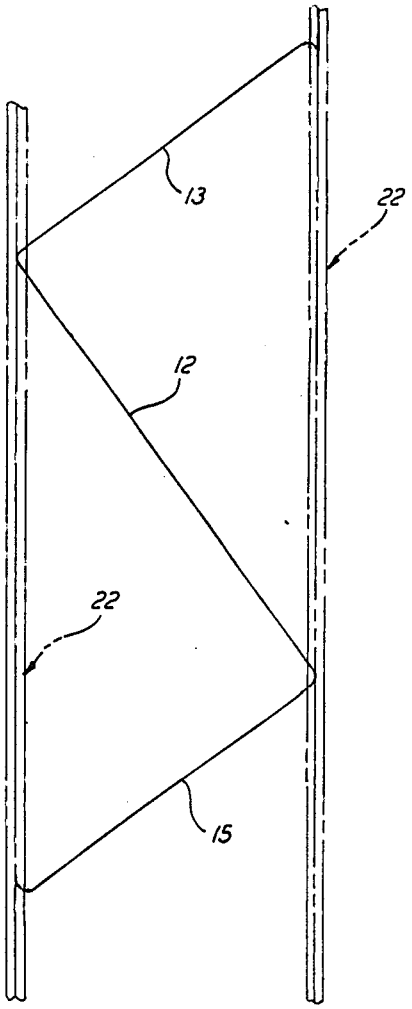
FIG. 4 is an end view showing the support member extended between the beams into a loaded condition whereby the member is locked in biasing contact against the adjacent beams.

With further reference to FIGS. 3 and 4, insulation 20 is secured in place using a series of support members 10 that are laid end to end between the lower flanges 29—29 of adjacent beams at spaced intervals along the length of the beams. The center leg 12 of the support member 10 has an axial length that is substantially greater than the space d (FIG. 2) between the webs of the adjacent beams while the length of the ends legs is only slightly greater than the space between the webs. Accordingly, the unloaded support members can be laid obliquely inside the lower flanges 29—29 of the beams as shown in FIG. 3 beneath the insulation strip.

To complete the installation of the wire support member, the installer simply grasps the two end legs 13 and 15 and pulls the legs in opposite directions to the extended position shown in FIG. 4. When extended, the end legs are positioned about 90° with reference to the center leg so that the member assumes a Z-like configuration between the adjacent beams. The wire is thus zig-zagged back and forth beneath the insulation and provides a continuous support for retaining the insulation strip in place along a considerable length of the strip to prevent the insulation from sagging or falling from between the beams.

As noted above, the axial length of each end leg is slightly greater than the space between adjacent webs. In practice each end leg is made about one or two inches longer than the web spacing. The wire, however, has sufficient resilience so that the end leg will flex as they are drawn through the relatively narrower perpendicular space between the webs thus enabling the member to be drawn into the loaded Z-like configuration shown in FIG. 4. The loaded spring member will attempt to return to its loaded condition but will be prevented from doing so by the interfering beams. Accordingly, the legs of the extended member are locked in biasing contact against the adjacent beams to retain the insulation in place. To facilitate the extension of the end legs along the beams, the distal end of each leg is turned inwardly toward the center leg about 120° to form a guide 31. A series of expanded wire members are laid end to end along the length of the beams thereby preventing the retained insulation from sagging or falling from between the beams.

While this invention has been described in detail with respect to a preferred embodiment, it should be understood that many modifications and variations would be apparent to those of skill in the art without departure from the scope and spirit of the invention, as defined in the appended claims.

What is claimed is:

1. Apparatus for supporting insulation in a building structure wherein a spaced series of beams are provided, each beam having a flange on opposite ends, said apparatus having a one piece wire spring member which, when in an unloaded condition, contains three parallel legs that include a center leg having a length that is substantially greater than the space between adjacent beams, and a pair of end legs each having a length that is only slightly greater than said distance whereby the spring member can be obliquely mounted inside the flanges of adjacent beams and the end legs of the member extended outwardly from the center leg in a plane to position the end legs at about right angles with the center leg to lock the member in a loaded condition against the adjacent beams and thus retain the insulation between said beams.

2. The apparatus of claim 1 wherein said member is formed of between 1/16" and ⅛" diameter wire.

3. The apparatus of claim 1 wherein the end legs of the wire member are between one and two inches longer than the said distance between beams.

4. The apparatus of claim 1 wherein the distal end of each end leg is turned inwardly toward the center leg to form a circular guide.

5. A building structure that includes a series of aligned beams defining a wall, each beam having a central web and a front flange and a back flange, panel means mounted upon the front flanges of the beams to close the wall, a strip of insulation mounted between adjacent beams and seated against the panel means, wire spring members mounted between the insulation strips and the back flanges of adjacent beams, each spring member being formed of a single piece of wire which, when in an unloaded condition, has three parallel legs that include a center leg having a length that is substantially greater than the web distance between adjacent beams and a pair of end legs having a length that is slightly greater than said web distance whereby the spring member can be obliquely mounted inside the back flanges of adjacent beams and the end legs extended from the center leg to position the end legs at about right angles with the center leg to lock the spring member in a loaded condition against the webs of adjacent beams and thus hold the insulation between said beams.

6. The building structure of claim 5 wherein the distal end of each spring member end leg is turned inwardly toward the center leg.

7. The building structure of claim 5 whereby the beams are formed of metal.

* * * * *